United States Patent [19]

Nelson et al.

[11] 4,299,589

[45] Nov. 10, 1981

[54] CLOSURE ASSEMBLY POSITIONING APPARATUS

[75] Inventors: Douglas G. Nelson, Franklin, Ohio; Donald F. Freund, Macon, Ga.

[73] Assignee: The Mead Corporation, Dayton, Ohio

[21] Appl. No.: 132,064

[22] Filed: Mar. 20, 1980

[51] Int. Cl.[3] ..... B31B 17/02

[52] U.S. Cl. ..... 493/109; 493/158

[58] Field of Search ..... 493/108, 109, 103, 104, 493/152, 158, 159, 156; 113/120 XY, 120 Y; 229/5.7

[56] References Cited

U.S. PATENT DOCUMENTS

| | | | |
|---|---|---|---|
| 2,323,914 | 7/1943 | Jordan et al. | 113/120 XY X |
| 2,584,718 | 2/1952 | Laabs | 493/103 X |
| 3,012,483 | 12/1961 | Liebreich | 493/108 |
| 3,264,795 | 8/1966 | Bauer | 493/103 X |
| 3,322,046 | 5/1967 | Hall, Jr. | 493/103 |

*Primary Examiner*—James F. Coan

*Attorney, Agent, or Firm*—Stephen H. Cagle; C. N. Shane, Jr.; Wilson G. Palmer

[57] ABSTRACT

Apparatus for positioning a chime ring member of a drum closure assembly into an interference, fitted relationship, with a fibre drum. The apparatus comprises a support frame and a sliding head assembly mounted on the support frame. The sliding head assembly includes a chime ring retaining member. A drum support assembly is also mounted on the support frame and includes a first and second drum retention means. The first drum retention means prevent movement of the drum during positioning of the chime ring member while the second drum retention means guides the concentric expansion of the top portion of the drum. Means are also provided for actuating movement of the sliding head assembly as well as a source of power for supplying energy to the sliding head assembly.

4 Claims, 7 Drawing Figures

CLOSURE ASSEMBLY POSITIONING APPARATUS

BACKGROUND OF THE INVENTION

1. Subject Matter

This invention relates to apparatus for the positioning of a chime ring member of a drum closure assembly into an interference, fitted relationship with a drum.

2. Prior Art

The drum which will be referred to in this application is a fibreboard drum of tubular form, which may be of laminated or nonlaminated structure. This type of fibreboard drum and the method for manufacturing same are disclosed in U.S. Pat. No. 3,039,371 to Leibreich. The primary advantage of fibreboard drums is that they can be manufactured in tubular form and then shipped or stored in flat form, thus presenting a substantial savings in terms of space usage. For the purpose of this application, these fibreboard drums are sometimes referred to as "KD Drums", the KD standing for "Knocked Down" which is simply descriptive of the condition in which the tubular fibreboard drums can be shipped and stored.

As can be appreciated, these drums are available in a variety of sizes, shapes, thicknesses and for a number of purposes. As explained above, the fibreboard drum may be of laminated or nonlaminated structure. If laminated, inner and outer plys are preferably of conventional Kraft paper which may be either wet or dry finished. So, to, if the fibreboard is of nonlaminated construction, its opposite surfaces are wet or dry finished as may be required. In either construction, the surface of the fibreboard is preferably impervious to liquids, and the inner surface or in some instances both the inner and outer surfaces are lined with a protective coating of any conventional composition.

The drum containers are frequently used for packing such material as asphalt, rubber and the like which is poured in place in a liquid condition to be hardened upon cooling. For packaging such material, the interior surface of the drum is lined with any conventional coating material, i.e., silicone, polyethylene, polypropylene, that is commonly used for the purpose of rendering the drum impervious to absorption from the contents contained within the drum or moisture from outside ambient conditions. The tubular form is made from a fibreboard blank with its side edges overlapped and joined to any desired extent for forming the lap joint extending lengthwise of the tubular form. Adhesives, staples or other fastening means can be used to join the side edges.

Recently, it has been shown that other materials such as food slurries and the like can be conveniently packaged in fibreboard drums for shipping and storage. Other uses to which the fibreboard drums can be placed are obvious to one of ordinary skill in the art. In particular, there are in reality no limitations on the materials which can be retained or shipped by the fibreboard drums of this invention. In many instances, specific uses require modifications of the innermost protective or barrier coating of the fibreboard meet relevant Food and Drug Administration guidelines or the like, but in no instances are the technical problems with the formulation and use of such coatings serious. Therefore, for purposes of this application, it will be assumed the fibre drum closure assembly can be used with any such material and the specific use of the drum of the particular material to be contained by the drum are not alleged to be inventive features herein.

Logically, it has been found that the effective commercial use of the fibre drum disclosed hereinabove requires both a bottom closure member and a top closure member. It has been known to use a metal disk as the bottom for drum members. The use of such bottom members and an apparatus for producing a container having a tubular fibreboard body portion and a metal disk bottom member is described by U.S. Pat. No. 3,057,265 issued to Leibreich in 1962. In this patent it is described how drums can be formed and a metal bottom seamed onto the bottommost edge of the tubular container member. In this fashion a fibreboard drum is formed having a sealed bottom member but having no top.

There have been a variety of previous attempts in the use and manufacture of a top closure member for use with fibreboard drums. The previous attempts to produce such drums consistently suffer from disadvantages. Among these are that the top member did not provide a good seal and, therefore, could not be used for materials which could leak or which could be spoiled or otherwise disadvantages by exposure to the atmosphere. Secondly, many of the prior art attempts to form a top closure member did not have stacking capabilities which provide a substantial advantage in the shipping and storage of the fibreboard drums once they have been filled. Third, many of these prior art top closure members required actual assembly on a machine such as a seaming machine. This is, of course, extremely cumbersome, expensive and not time efficient. Finally the prior closure members either did not hold the fibreboard drum round for purposes of filling. As can be appreciated, it is necessary for the fibreboard drum to be held in a substantially round configuration during filling so that the maximum amount of material can be inserted into each drum. The drum closure assembly of this invention solves all of these and other problems which have been appreciated by the prior art.

Other patents of which the applicants are aware which deal with the concept of closing drums include:

U.S. Pat. No. 801,382 to Keyes (1905)
U.S. Pat. No. 1,528,489 to Snell (1926)
U.S. Pat. No. 1,725,525 to Kondolf (1929)
U.S. Pat. No. 3,054,548 to Scott (1962)
U.S. Pat. No. 3,297,193 to Stevens (1967)
U.S. Pat. No. 3,843,013 to Brooks (1974)

Other prior art which is relevant to either paperboard drums or else machines for closing the ends of drums and the like or to apparatus for applying adhesives and the like are:

U.S. Pat. No. 2,820,584 to Hendry (1958)
U.S. Pat. No. 2,888,184 to Hendry (1959)
U.S. Pat. No. 3,012,483 to Leibreich (1961)
U.S. Pat. No. 3,024,763 to Leibreich (1962)
U.S. Pat. No. 2,966,833 to Leibreich (1961)

SUMMARY OF THE INVENTION

Figure 1:
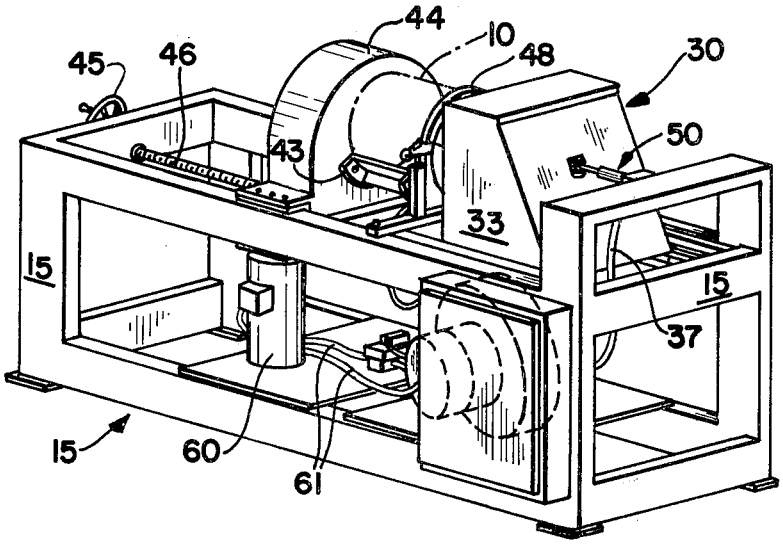
FIG. 1 is a perspective view showing the drum closure assembly positioning apparatus of this invention with a fibre drum locked in place and with the sliding head assembly in partially extended position.

Apparatus for positioning a chime ring member of a drum closure assembly into an interference, fitted relationship, with a fibre drum. The apparatus comprises a support frame and a sliding head assembly mounted on the support frame. The sliding head assembly includes a chime ring retaining member. A drum support assembly is also mounted on the support frame and includes a first and second drum retention means. The first drum retention means prevent movement of the drum during positioning of the chime ring member while the second drum retention means guides the concentric expansion of the top portion of the drum. Means are also provided for actuating movement of the sliding head assembly as well as a source of power for supplying energy to the sliding head assembly.

DESCRIPTION OF THE PREFERRED EMBODIMENTS

For the purposes of promoting an understanding of the principles of this invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention as illustrated therein comtemplated as would normally occur to one skilled in the art to which the invention relates.

The fibreboard drum 10 is made from a wet strength Kraft and has a wall thickness of 0.01 inches to 0.09 inches. Preferably the wall thickness, including all laminate layers, is from about 0.015 inches to about 0.075 inches. A most preferred range for wall thickness is from about 0.019 inches to about 0.045 inches. For commercial purposes it has been found that the diameter of the fibreboard drum should be from about 5 inches to about 24 inches and the height of the drum up to about 72 inches. Dimensions substantially larger and smaller than these can be very conveniently used depending upon the product to be packaged and on available apparatus for assembling and seaming bottoms onto such drums.

The fibreboard drums 10 are in general tailored for a specific purpose and are most preferably used for carrying materials that are poured in hot, liquid form and then solidified, such as asphalt, adhesives, resins, and waxes. The fibreboard drums 10 are, however, equally adaptable and, in fact, have shown great utility in the storage of materials in cold or frozen form. The interior 11 of the fibre drums 10 can be specially coated to meet the release and/or protective requirements of any product it carries. Coatings can be used to insure greaseproofness, moisture and water proofness among other characteristics. Regulatory agency, i.e., FDA, is sometimes used as a reason for coating the interior of drums. Coatings can in some instances be eliminated if plastic inner bags are to be used in the fibre drum. For tacky products such as asphalt, resin, adhesives, etc., coatings can be used to give positive release from the drum wall, even when the drum is filled at high temperatures. As has been stated hereinabove, the specific size or coated features of the drum 10 of this invention is not alleged to be an inventive feature herein. Rather, it is merely stated that the drum 10, the metal bottom which is seamed onto the drum and the particular drum closure assembly must be cooperatively sized to form an effective container.

Figure 7:
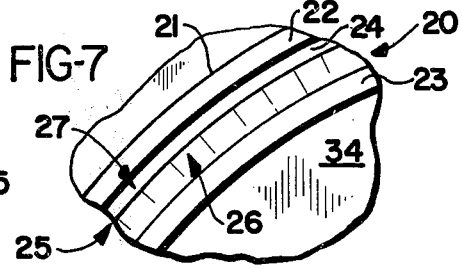
FIG. 7 is a partial cross-sectional view taken of a ring member of a drum closure assembly.

A first element in the drum closure assembly 20 which is necessary for use with the apparatus of this invention is ring member 21. In describing ring member 21 attention is drawn specifically to FIG. 7. Ring member 21 consists of an outer ring portion 22, an inner ring portion 23 and a connection portion 24. In the most preferred embodiment of this invention, ring member 21 is made from a moldable, resiliently flexible material such as polyethylene or other plastic material, and portions 22, 23 and 24 form a continuous structure.

In the preferred ring member 21 for use with the apparatus of this invention, the positioning of outer ring portion 22, inner ring portion 23 and connecting portion 24, define an elongated groove 25. Elongated groove 25 is continuous throughout the circumference of ring member 21 and is preferably funnel shaped at the open end of groove 25 to provide means for guiding drum 10 into groove 25. Specifically, it is noted that the mouth 26 of groove 25 is substantially wider than the innermost recessed portion 27 of groove 25.

Other detailed information concerning the drum closure assembly for use in combination with the apparatus of this invention can be found in commonly assigned U.S. Pat. No. 4,182,475 as well as commonly assigned pending application U.S. Ser. No. 078,116, filed Sept. 24, 1979. The content of this patent and pending application are hereby incorporated by reference.

Referring now more particularly to the drawings, it can be seen that the drum closure assembly postioning apparatus of this invention comprises a support frame 15, a sliding head assembly 30, a drum support assembly 40, actuating means 50, and a power source 60. Specifically referring now to FIG. 1, it can be seen that a support frame 15 is provided for supporting the entire structure of the apparatus of this invention. The particular configuration of support frame 15 is not critical to this invention and it is merely necessary that the support frame provide a functional support for the sliding head assembly 30 and drum support assembly 40. Optionally, support frame 15 can be movable as by mounting said frame on rollers, casters or the like. Support frame 15 can be made of any of a variety of well known materials including various metals, woods and plastics and/or combination of one or more of the above.

Figure 2:
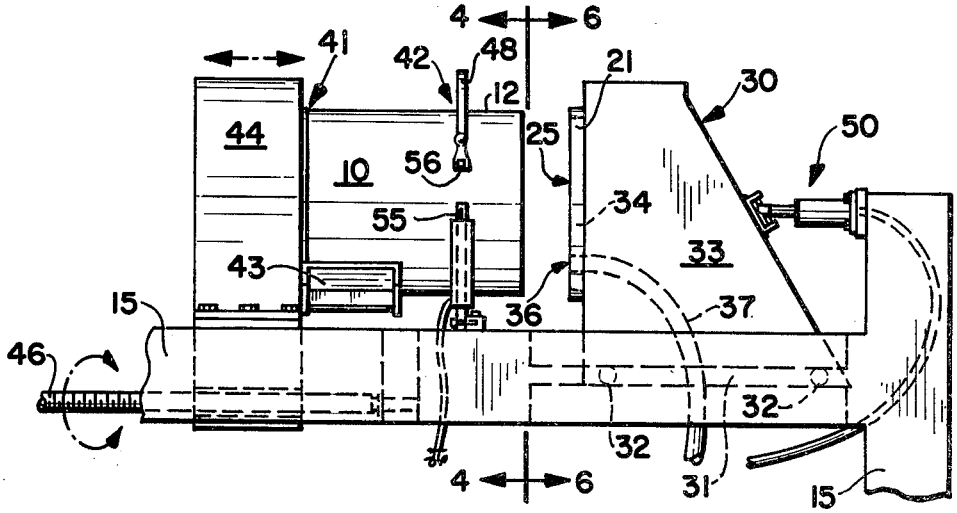
FIG. 2 is a side view of the drum closure assembly positioning apparatus of this invention.
Figure 3:
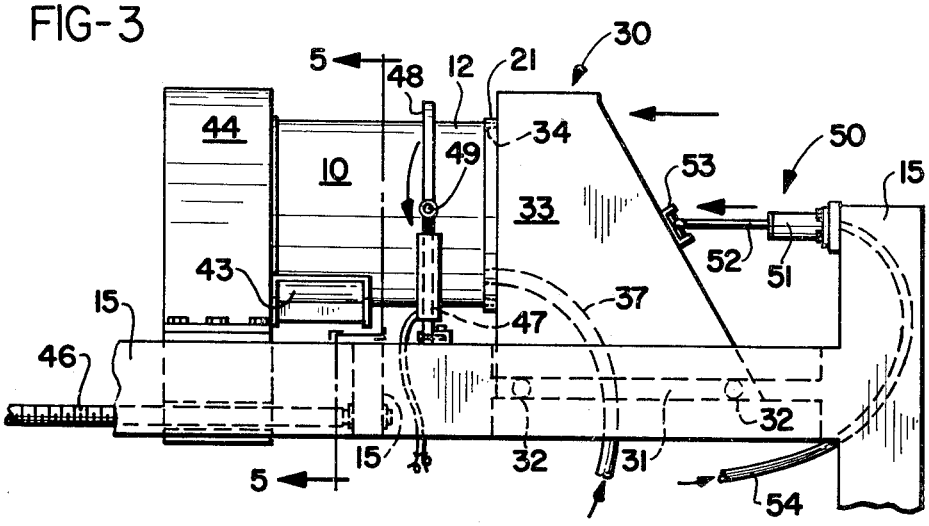
FIG. 3 is a side view of the drum closure assembly positioning apparatus of this invention similar to that shown in FIG. 2 with the exception that the sliding head assembly is positioned such that it is extended and is positioning the chime ring onto the fibre drum.

Referring now more particularly to FIGS. 2 and 3 it can be seen that the sliding head assembly 30 comprises a pair of guide tracks 31 which are attached to the support frame 15. Guide tracks 31 engage sliding head assembly 30 which is lineally movable in guide tracks 31. In the most preferred embodiment of this invention bearings 32 are attached by conventional means to cover member 33 of sliding head assembly 30. The bearings 32 are then lineally movable in guide tracks 31 to guide the linear movement of sliding head assembly 30.

Other conventional means for lineally moving sliding head assembly 30 are well within the ambit of this invention. It should be noted that it is only necessary that sliding head assembly be movable for from about ½ inch to about 6 inches. Movement of sliding head assembly 30 is actuated by actuating means 50 which in this preferred embodiment comprises a hydraulic cylinder 51 with a protruding piston 52 which is fixedly attached to the cover member 33 by means of arcuately movable connector 53. Hydraulic cylinder 51 is in turn connected by a flexible hose means 54 to a reservoir of hydraulic fluid maintained on support frame 15 and suitably attached to power source 60.

Figure 6:
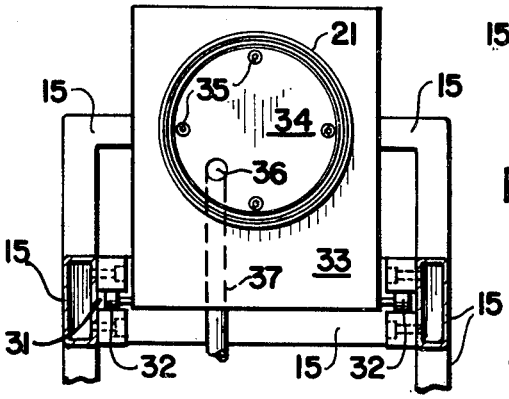
FIG. 6 is a front view taken along line 6—6 of FIG. 2 showing the front view of a sliding head assembly of the apparatus of this invention.

Also included in sliding head assembly 30 is chime ring retaining member 34. In the preferred embodiment of this invention, and as is shown more particularly by FIG. 6, retaining member 34 comprises a raised portion from cover member 33 which is attached to cover member 33 by lug bolts 35. Retaining member 34 is sized such that the outside diameter of member 34 is slightly smaller than the inside diameter of ring member 21. During actual operation of the apparatus of this invention, a ring member 21 is placed by hand over retainer member 34 and a fibreboard drum 10 is placed by hand into drum support assembly 40 and then actuating means are connected to form the cylindrical drum top closure assembly. It should be noted that other forms of the retainer member 34 are also equally viable. For instance, a plurality of spaced protrusions can be used to retain the chime ring while it is being positioned on the fibre drum 10.

It has been found during actual use of the apparatus of this invention that fibre drums which are shipped in the Knocked Down configuration have a tendency to retain a somewhat elliptical shape until they are finally formed. This has presented a problem in the proper nesting of the chime ring member 21 on the drum 10. Therefore, the sliding head assembly and specifically the chime ring retainer member 34 of the sliding head assembly 30 is fitted in the preferred embodiment of this invention with an aperture 36 through which air is forced continuously. This forced air creates a pressure when the sliding head assembly engages or begins to engage the drum 10 and forces the concentric expansion of the fibre drum 10 to the proper alignment. The aperture 36 is connected to a source of pressurized air by flexible hose 37 and is supported by support frame 15.

Figure 4:
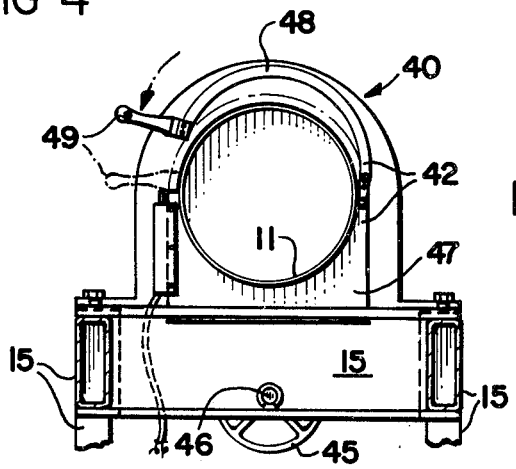
FIG. 4 is a front view taken along line 4—4 of FIG. 2 and showing the drum retaining means.
Figure 5:
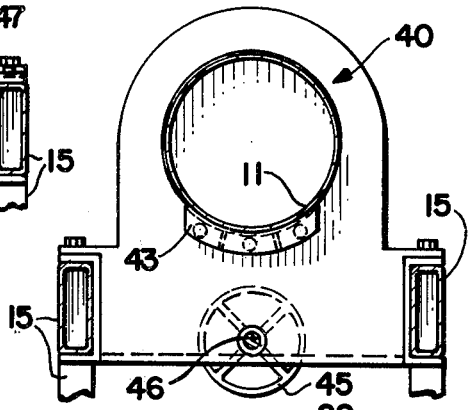
FIG. 5 is a cross-sectional view taken along line 5—5 of FIG. 3 and showing the first retaining member with the fibre drum in place.

Referring now more particularly to FIGS. 2, 4 and 5 the drum support assembly 40 is demonstrated. Drum support assembly 40 includes a first drum retention means 41 for preventing movement of the drum 10 during positioning of the chime ring member 21 and second drum retention means 42 for guiding the concentric expansion of the uppermost portion 12 of the fibre drum 10.

The first drum retention means 41 include an arcuate support member 43 and a base support structure 44. Members 43 and 44 act in conjunction with one another and, in fact, are joined with one another to prevent linear or vertical movement of the fibre drum 10 during the positioning of chime ring member 21.

In the most preferred embodiment of this invention first drum retention means 41 are lineally movable to provide for the various sizes of fibre drums 10 which may be used. The means for linear movement of first drum retention means 41 are shown more particularly in FIGS. 1 and 5 wherein a hand wheel 45 attached to a screw mechanism 46 provide the mechanical means for adjusting lineally the distance between first drum retention means 41 and specifically base support structure 44 of means 41 from sliding head assembly 30 and more particularly chime ring retainer member 34.

Second drum retention means 42 are shown more particularly in FIGS. 3 and 4. Means 42 comprise a circular form which consists of a base portion 47 and a mated top portion 48. Top portion 48 is pivotally joined to base portion 47 to provide for movement of the top portion 48 up and down to insert or remove fibre drums 10. This can be done by grasping handle 49 and raising top portion 48 as is demonstrated in FIG. 4. Second drum retention means 42 also provide a guide for the concentric expansion of fibre drum 10 from the forced air being inserted through aperture 36 during positioning of the chime ring member 21.

It has also been found beneficial to have the actuating means, electrical or otherwise be found in a locking mechanism wherein top portion 48 and base portion 47 of second drum retention means 42 are joined when they have engaged a drum 10. This presents a significant safety advantage in the apparatus of this invention as the sliding head assembly 30 is not engaged until the drum retention means 42 have been engaged. The particular nature of the actuating means 50 as they are found in the junction of members 47 and 48 are not asserted to be inventive features herein. However, for purposes of illustration in FIG. 2 a normal electrical coupling device is shown wherein a coupling device 55 causes electrical connection to take place when inserted through opening 56 and handle 49. This is, however, but one embodiment of the various options which are available.

Mounted on support frame 15 is power source 60. Power source 60 can be any of a conventional number of means for providing power to a unit such as this. In particular, note that in the preferred embodiment power source 60 is pneumatic and is connected to sliding head assembly 30 by a variety of lines generically identified as 61. In the preferred embodiment where power source 60 is pneumatic it is preferred that electrical power means be present to supply pressurized air through flexible hose 37. Such electrical means are shown more clearly by dotted lines in FIG. 1 wherein the electrical means comprises a fan. In operation this apparatus can be conveniently operated by a single individual. The source of air being supplied through aperture 36 and flexible hose 37 is maintained constantly. A fibre drum 10 in its Knocked Down condition is first opened and a metal bottom is seamed on in the fashion taught by the prior art. The resulting fibre drum will typically contain a circular bottom where the metal bottom has been joined but the opposite end will be somewhat elliptical in nature. This fibre drum is then inserted into the apparatus and specifically into the drum support assembly 40 by placing the metal bottom portion of the partially assembled drum into contact with the base support structure 40 and by placing the side wall of the fibreboard drum into contact with the arcuate support member 43. If necessary, hand wheel 45 and screw mechanism 46 can be used to lineally adjust the placement of drum support assembly 40. After this a ring member 21 is placed on chime ring retainer member 34. Second drum retention means 42 is then closed and locked around the uppermost portion 12 of the fibreboard drum 10 which actuates power source 60. Power source 60 then lineally actuates movement of sliding head assembly 30 which has ring member 21 properly aligned thereon into a relationship whereby ring member 21 is placed fixably onto fibre drum 10. Sliding head assembly 30 automatically withdraws leaving ring member 21 onto fibreboard drum 10. The top portion 48 of second drum retention means 42 is then raised and the assembled fibre drum is removed for filling and capping.

While the invention has been illustrated and described in detail in the drawings and the foregoing description, the same is to be considered as illustrated and not restricted in character, it being understood that only the preferred embodiment has been shown and described and that all changes and modifications that come within the spirit of the invention are desired to be protected.

What is claimed is:

1. Apparatus for the positioning of a chime ring member of a drum closure assembly into an interference, fitted relationship with a drum comprising:

(a) a support frame;

(b) A sliding head assembly mounted on said support frame, said sliding head assembly including chime ring retaining means and pressure expansion means for applying pressure to the inside of said drum to promote the concentric expansion of said drum wherein said means comprise a supply of pressurized air applied through an aperture located in said raised disc portion of said sliding head assembly, said aperture being positioned such that the air flowing through said aperture is directed into the open end of said drum;

(c) a drum support assembly mounted on said support frame, said drum support assembly including:

(i) first drum retention means for preventing movement of said drum during positioning of said chime ring member, and (ii) second drum retention means for guiding the concentric expansion of the top portion of said drum;

(d) means for actuating movement of said sliding head assembly; and (e) a source of power for supplying energy to said sliding head assembly.

2. The apparatus of claim 1 wherein said support frame is mounted on rollers.

3. The apparatus of claim 1 wherein said means for actuating movement of said sliding head assembly is located in said second drum retention means.

4. The apparatus of claim 3 wherein said second drum retention means in addition to functioning as a retainer for the top portion of the drum also functions as the means for actuating movement of said sliding head assembly, said second drum retention means comprising a hinged circular member which is aligned such that when in the open position the actuating movement is stopped and when in the closed position the actuating means are engaged and the sliding head assembly is caused to move lineally by said source of power.

* * * * *